US005241806A

United States Patent [19]

Ziegler et al.

[11] Patent Number: 5,241,806

[45] Date of Patent: Sep. 7, 1993

[54] CONTINUOUS MOTION CARTONER ASSEMBLY

[75] Inventors: Kelly W. Ziegler; Allen L. Olson, both of Crosby; Curt W. Lovold, Baxter, all of Minn.

[73] Assignee: Riverwood International Corporation, Denver, Colo.

[21] Appl. No.: 856,450

[22] Filed: Mar. 24, 1992

[51] Int. Cl.[5] ..... B65B 35/44; B65B 35/54

[52] U.S. Cl. ..... 53/566; 53/237; 53/252; 53/257

[58] Field of Search ..... 53/566, 564, 55, 543, 53/251, 468, 255, 258, 257, 237, 252

[56] References Cited

U.S. PATENT DOCUMENTS

| | | | |
|---|---|---|---|
| 3,778,959 | 12/1973 | Langen et al. | 53/26 |
| 3,956,868 | 5/1976 | Ganz et al. | 53/566 X |
| 4,237,673 | 12/1980 | Calvert et al. | 53/48 |
| 4,250,693 | 2/1981 | Andersson | 53/566 X |
| 4,693,055 | 9/1987 | Olsen, Jr. et al. | 53/237 X |
| 4,802,324 | 2/1989 | Everson | 53/398 |
| 4,936,077 | 6/1990 | Langen et al. | 53/543 |
| 4,982,551 | 1/1991 | Nigrelli, Sr. | 53/566 X |
| 5,036,644 | 8/1991 | Lashyro et al. | 53/398 |
| 5,072,573 | 12/1991 | Tisma | 53/257 X |

*Primary Examiner*—James F. Coan

*Attorney, Agent, or Firm*—Joel D. Skinner; Anthony G. Eggink

[57] ABSTRACT

A cartoner assembly loading article groups into open carton sleeves. The cartoner assembly comprises an article infeed mechanism supplying at least one stream of articles, an article selecting mechanism intersecting the article infeed mechanism to form and move a stream of article groups of a predetermined pattern, a carton supply mechanism synchronized and moving parallel with said article selecting mechanism to provide cartons with open ends facing the moving article groups, and an article group transfer mechanism constructed and arranged to move article groups into the open ends of the carton sleeves.

20 Claims, 13 Drawing Sheets

CONTINUOUS MOTION CARTONER ASSEMBLY

BACKGROUND OF THE INVENTION

This invention relates to cartoner assemblies and methods for the packaging industry. Particularly, this invention relates to continuous motion cartoner assemblies to load article groups into opened carton sleeves.

The cartoner assembly of the present invention is particularly designed to be fully adjustable to package different types, styles and sizes of articles, i.e. cans and bottles, and a wide range of article group patterns. The cartoner assembly is easily adjustable to meet the changes of these article parameters and loads the article groups into the carton sleeves in a fast and reliable manner.

In the past, various machines and processes have been proposed and utilized to continuously package selected article groups into cartons. Each prior art machine and process, however, accomplishes the packaging of the article groups in a distinct manner and utilizes particular machinery. For example, article groups can be continuously selected from an article infeed stream or provided in a preselected manner, dropped into or placed onto partially opened or erected cartons and subsequently closed. Alternatively, carton blanks are folded and constructed about individual article groups, which generally requires the use of particular carton structures as well as cooperating carton folding and constructing equipment. These prior art cartoners have limited adjustability, limited output capability, restricted use and have been difficult and costly to maintain due to their respective designs.

Prior art cartoner assemblies include U.S. Pat. No. 4,802,324 to applicants' assignee for a Vertical Cartoning Assembly and Method which discloses the placement and assembly of cartons over preselected article groups being moved on a conveyor. In operation, folded cartons are placed between carton flights and lowered over moving preselected article groups by means of a cam rail/cam follower structure. The cartons are subsequently folded and closed into a wrapped configuration to yield a stream of packaged product. Further, U.S. Pat. No. 5,036,644, also to applicants' assignee, discloses a Packaging Sleever Assembly which transfers flat packaging sleeves directly onto preselected article groups and subsequently wraps and closes the cartons. The latter assembly utilizes cam actuated flight bar structures which move in a generally perpendicular direction relative to the article transfer conveyor to select article groups and to transfer carton sleeve structures for subsequent wrapping and closing.

Various end loading packaging machines have also been proposed in the art. For example, U.S. Pat. No. 3,778,959 to Langen et al. discloses an end loader which utilizes a plurality of transversely extending spaced apart fences or flights mounted on a conveyor to rake or capture a predetermined number of containers from infeed container slips. The fences or flights function in cooperation with stationary transverse guide rail structures to discharge the containers into an end loading shipper package. Further, U.S. Pat. No. 4,237,673 to calvert et al. discloses a machine also for loading container sleeves through their open ends. The latter machine utilizes a plurality of transverse parallel spaced apart metering bars together with fixed guides that are disposed at an acute angle to the path of the metering bars. The open ended sleeve type containers are carried between the metering bars and the metered packages are forced along the fixed guides and into the open ends of the respective packages. Although these disclosures show machines which load article groups into the ends of cartons, these machines lack control of the article groups to provide finished packaged products that are tight and stable. These machines are also limited in packaging speed and are difficult to adjust with respect to the packaging of various article group orientations and carton sleeve sizes. U.S. Pat. No. 4,936,077 to Langen et al. discloses a carton loading machine which overcomes some of the problems and limitations of the '959 and '673 patent disclosures by utilizing pusher mechanisms with spring loaded pusher heads to stagger adjacent product group rows during transfer into the carton. The machine further utilizes cam activated spaced load divider blades along an angularly inclined discharge plane and between which the pusher mechanisms operate. This machine disclosure also lacks the amount of control and adjustability required for high speed packaging of varying article group orientations.

The present invention provides an adjustable continuous motion cartoner assembly which selects predetermined article group patterns from parallel infeed streams of articles and which transfers the article groups into the opened ends of carton sleeves being moved parallel to and in synchronization with the article groups. The cartoner assembly of the invention includes article group transfer structures which enable the individual rows of the article group to be moved and controlled with a positive force so that the article group can be tightly placed and maintained between the walls of the carton.

The cartoner assembly of the invention further provides article instream structures, article transfer structures and carton flight adjustment structures that permit easy adjustment of the assembly so that a variety of articles and article group patterns can be selected and controlled for transfer into the opened ends of a range of packaging carton sizes and configurations.

SUMMARY OF THE INVENTION

The present invention provides a cartoner assembly for loading article groups into open carton sleeves which comprises and article infeed means supplying at least one stream of articles, an article selecting means intersecting said article infeed means to form and move a stream of article groups of a predetermined pattern, a carton supply means synchronized and moving parallel with said article selecting mean to provide cartons with open ends facing said moving article groups, and an article group transfer means constructed and arranged to move article groups into the open ends of the carton sleeves.

It is an objective of this invention to provide an apparatus which continuously and reliably cartons predetermined product groups at high speed. Another object of this invention is to provide a continuous motion cartoner which is fully adjustable for use with a variety of cartons, product and and product group types and sizes. A particular object of the invention is to provide a cartoner comprising article selection means having a plurality of fixed, stationary flight bars disposed thereon which linearly select articles from an article infeed source which is angled with respect to the selection means. Another object of the invention is to provide a cartoner comprising article transfer means having transversely reciprocating arm assemblies including cam actuated stepped transfer heads for loading product groups in an initially nested configuration having a differentially thinner loading dimension. A further object of this invention is to provide a cartoner having cam actuated means to guide product groups into cartons. And, yet another object of this invention is to provide a cartoner which comprises carton transport means having improved carton flight phase adjustment means.

These and other benefits of this invention will become clear from the following description by reference to the drawings.

DESCRIPTION OF THE PREFERRED EMBODIMENT

Figure 1:
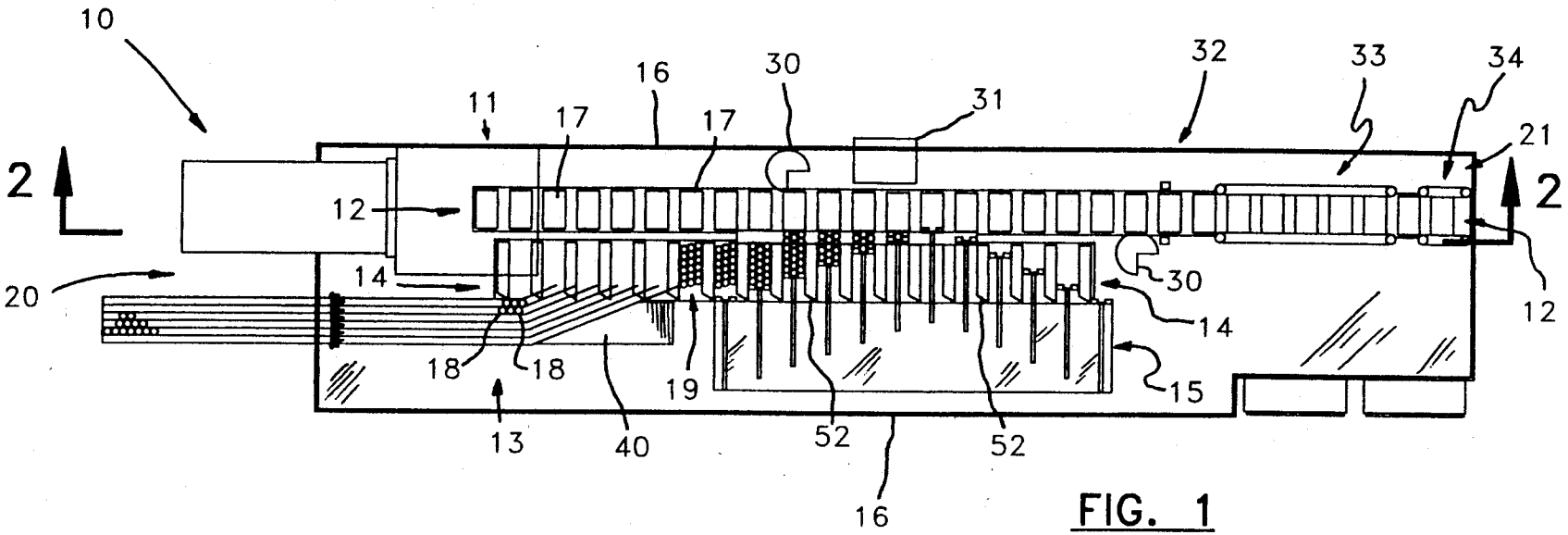
FIG. 1 is a top plan view of the continuous motion cartoner assembly of the present invention.

The apparatus and methods of the present invention are for loading articles into cartons in a continuous, high speed process. As shown in the drawings, the apparatus 10 of this invention is particularly useful in a continuous, high-speed packaging operation, and in cooperation with synchronized, related packaging apparatus. The apparatus 10 has a simplified structure, and is highly adjustable to provide reliable, continuous and high speed packaging of articles or products of varying types, sizes and quantities into cartons of varying types and sizes. For example, the apparatus 10 is useable to load canned or bottled beverages into common 6, 12 and 24 pack cartons and configurations utilizing the adjustment features described more fully below. Moreover, the process of loading beverage containers into cartons, for example, is accomplished quickly and reliably, under typical industry tolerances for both container and carton construction. Finally, the resultant filled cartons output by the apparatus 10 are of high quality and consistency, having maximized squareness and tautness for improved storage qualities and transportability. Finally, the apparatus of this invention provides high speed processing of from 250 to 600 cartons per minute depending upon carton size.

Figure 2:
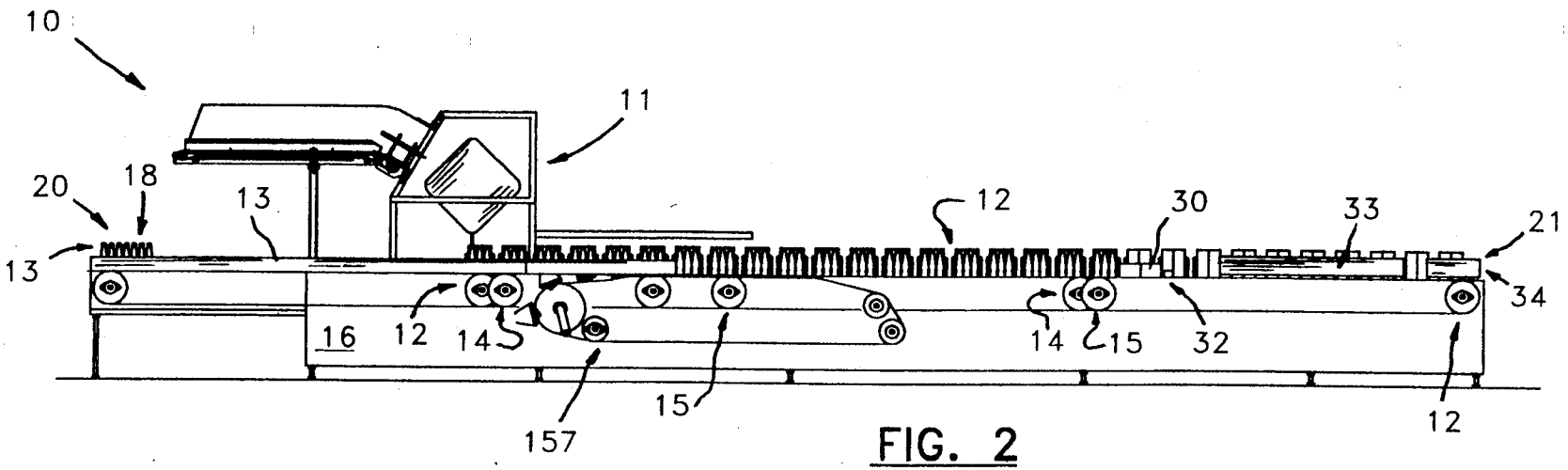
FIG. 2 is a side view of the cartoner assembly showing the carton supply and transport mechanisms thereof.

Referring to FIGS. 1 and 2, the continuous motion cartoner assembly 10 generally comprises at least one carton supply mechanism 11, a carton transport mechanism or conveyer 12, an article supply mechanism or conveyor 13, an article selection and transport mechanism or conveyor 14 and a product group transfer or cross loading mechanism 15. These mechanisms are shown to be supported by a unitary frame structure 16, although if aligned properly, separate support structures may be utilized consistent with the teachings of this invention. The carton supply mechanism 11 is shown to be disposed at an input end 20 of and in line with the carton transport mechanism 12 to supply cartons 17 thereto. The cartons 17 are subsequently transported in a linear fashion to an output end 21 of the apparatus 10. The article supply mechanism 13 is also shown to be disposed at the input end 20 of the apparatus 10. A first portion of the article supply mechanism 13 is disposed anterior to and spacially parallel to the article transport mechanism 14, and a second portion merges, at a predetermined angle, with a predetermined first segment of the article transport mechanism 14 to a supply a stream of product or articles 18 thereto. These merging mechanisms 13 and 14 are further constructed and arranged to meter individual articles 18 in the mechanism 13, via a fixed flight bar arrangement into predetermined product or article groups on conveyor 14. The article transport mechanism 14 is disposed adjacent and parallel to the carton transport mechanism 12. Further, the article transport mechanism 14 extends, in a linear fashion, from approximately the beginning of the carton transport mechanism 12, through a first portion (for article merging) and to a second portion which terminates at a point approximately two thirds length of the carton transport mechanism 12. The article groups 19 are transported downstream thereon in a spaced and metered fashion, each group 19 being aligned with a carton 17 traveling on the carton transport mechanism 12. The crossloading mechanism 15 is disposed adjacent to and parallel with the second portion of the article transport mechanism 14, extending and traveling linearly with respect to the upstream and downstream ends 20 and 21 of the apparatus 10. The crossloading mechanism 15 has means, extending transversely or perpendicularly with respect to the longitudinal axis of the transport mechanisms 14 and 12, to move product groups 19 on the article transport mechanism 14 into aligned cartons 17 traveling on the carton transport mechanism 12, thereby loading the cartons 17 with product groups 19. Preferably, each of the aforementioned mechanisms 12, 13, 14 and 15 has a conveyor type structure with an endless chain or belt configured about rotatable drive and idler end means, as know in the art, and moving longitudinally with respect to the input (upstream) and output (downstream) ends 20 and 21 of the apparatus 10. The movement of each mechanism is further synchronized with one another, for example by a common drive and/or gearing means. Synchronized operation of these cooperating mechanisms 12–15, along with that of the carton supply mechanism 11, provides a continuous apparatus and process for selecting and metering a stream of individual articles 18 traveling in one linear stream into predetermined groups 19 traveling in a second parallel, linear stream, which are subsequently transversely loaded into cartons 17 traveling in a third parallel linear stream.

Although the apparatus 10 shown in the drawings is utilized in a beverage bottle or can cartoning operation, modifications consistent with the teachings of this invention may be made to package various other liquid or gas containers or solid objects. Also, as shown in the drawings, various ancillary processing mechanisms may be incorporated in the structure of the basic apparatus 10. For example, in the beverage cartoning apparatus 10, flap tuckers 30 are disposed adjacent each side of the carton transport mechanism 12, one anterior to the loading region to provide a closed carton backside against which the loaded containers may nest, and one posterior to the loading region to allow ingress to the carton 17 through its open, unglued end flaps. Gluing, compression and discharge mechanisms 32, 33 and 34 are disposed consecutively, further downstream and adjacent the carton transport mechanism 12 to complete the carton flap securement process. The design of such mechanisms is well known in the art. A coupon placement mechanism 31 is also shown used in conjunction with the apparatus 10.

Figure 3:
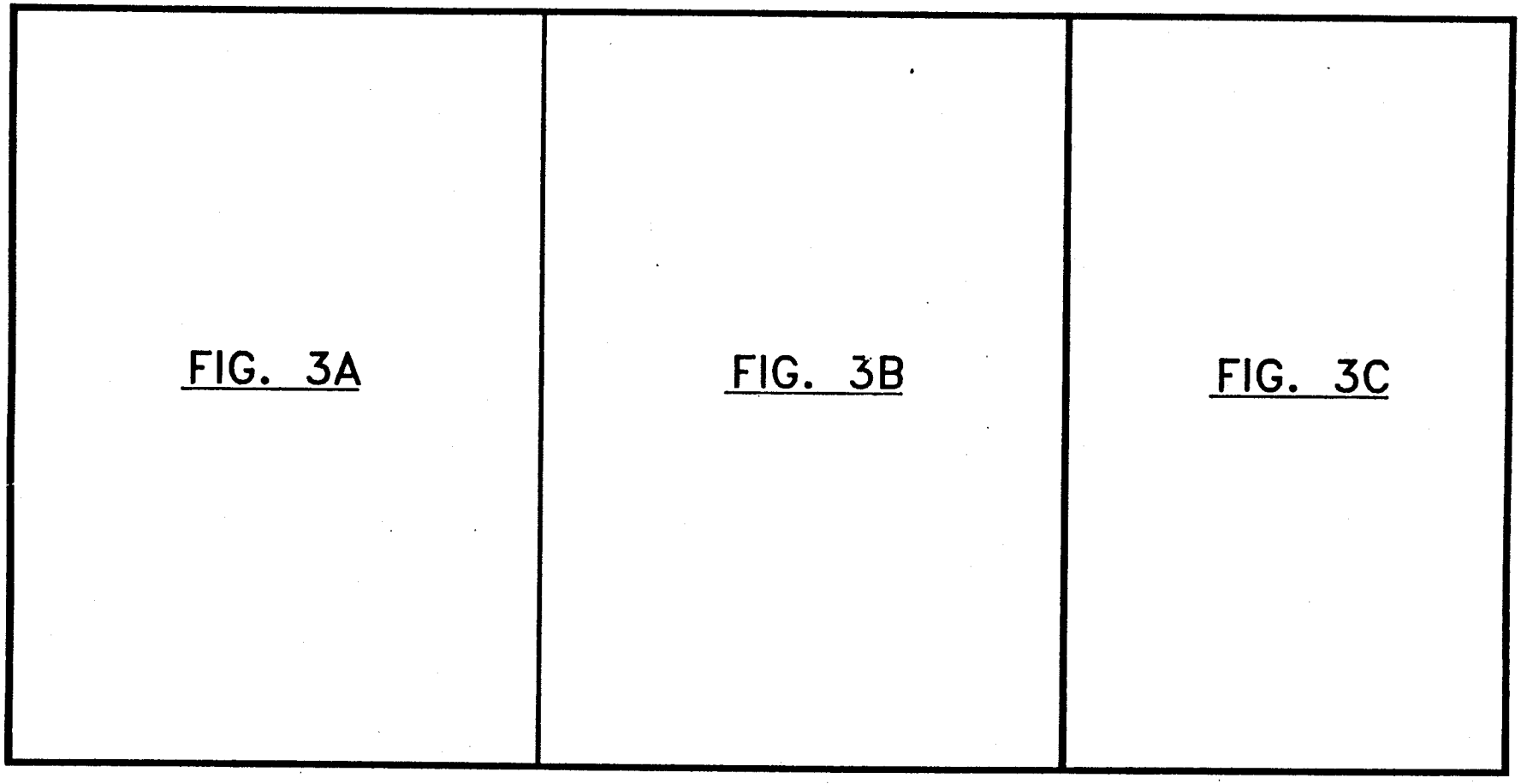
FIG. 3 is a diagram of the relative orientation of FIGS. 3A-3C.
Figure 3A:
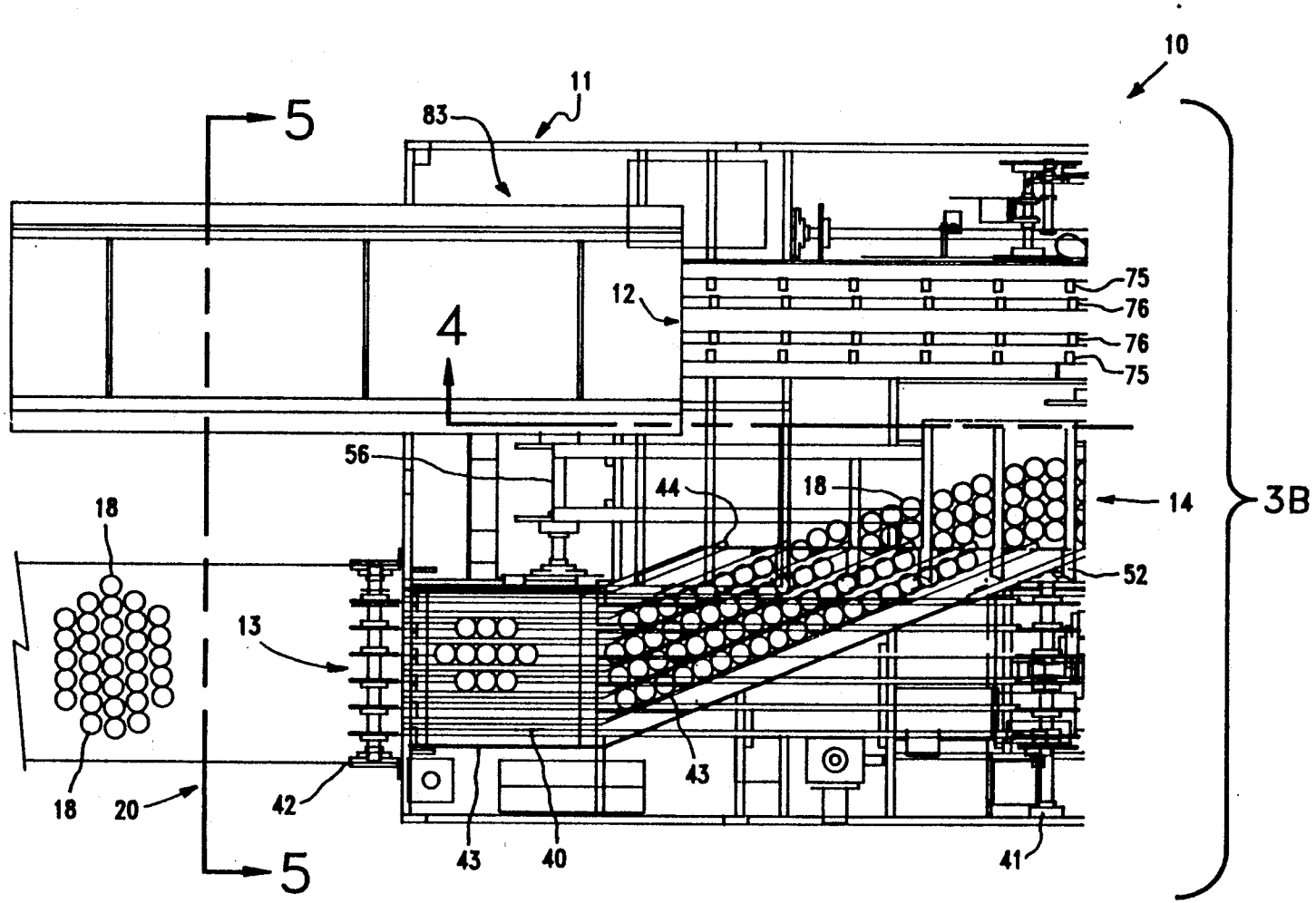
FIGS. 3A-3C are partial top plan views of the cartoner assembly.
Figure 3B:
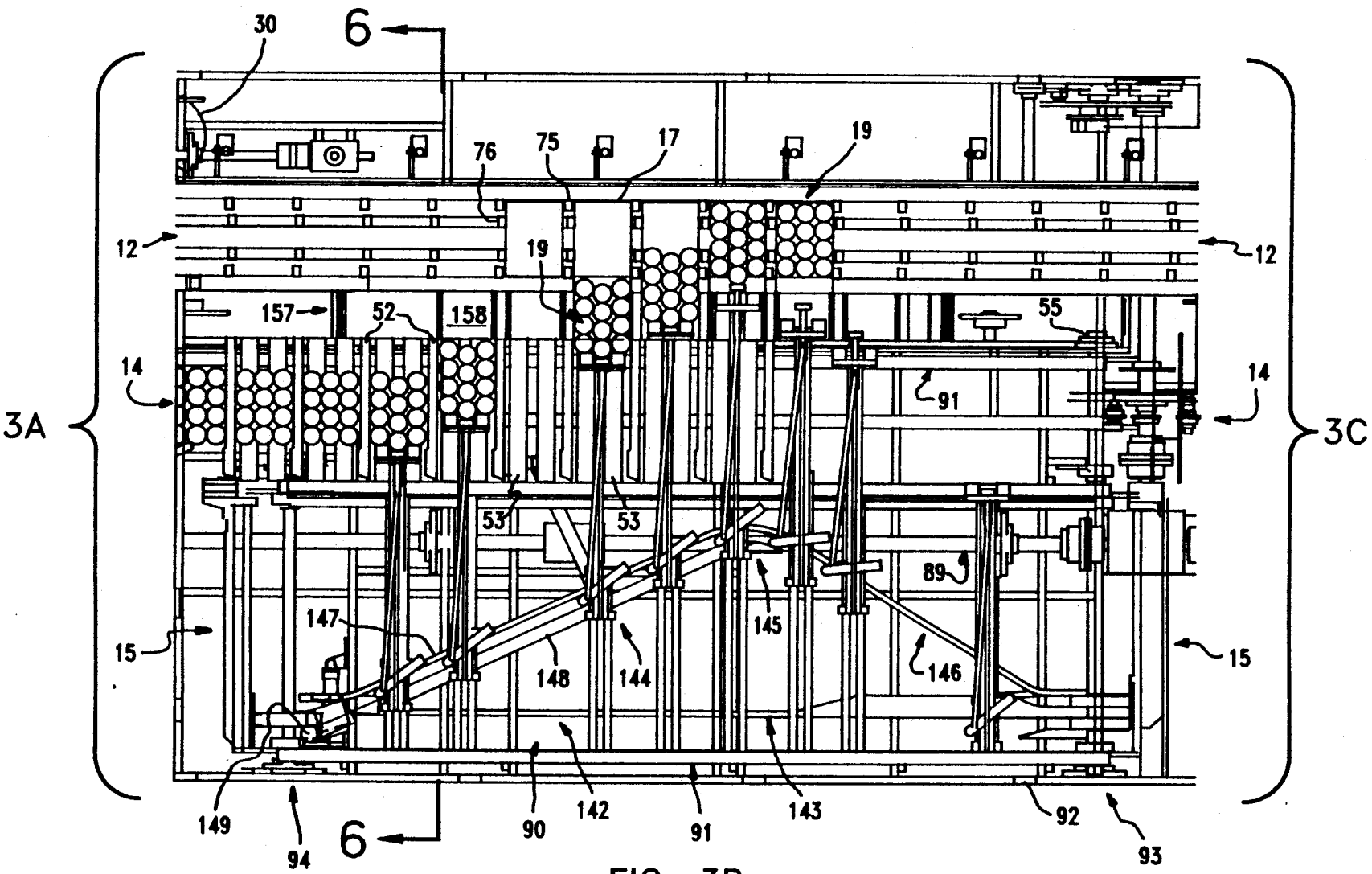
Figure 3C:
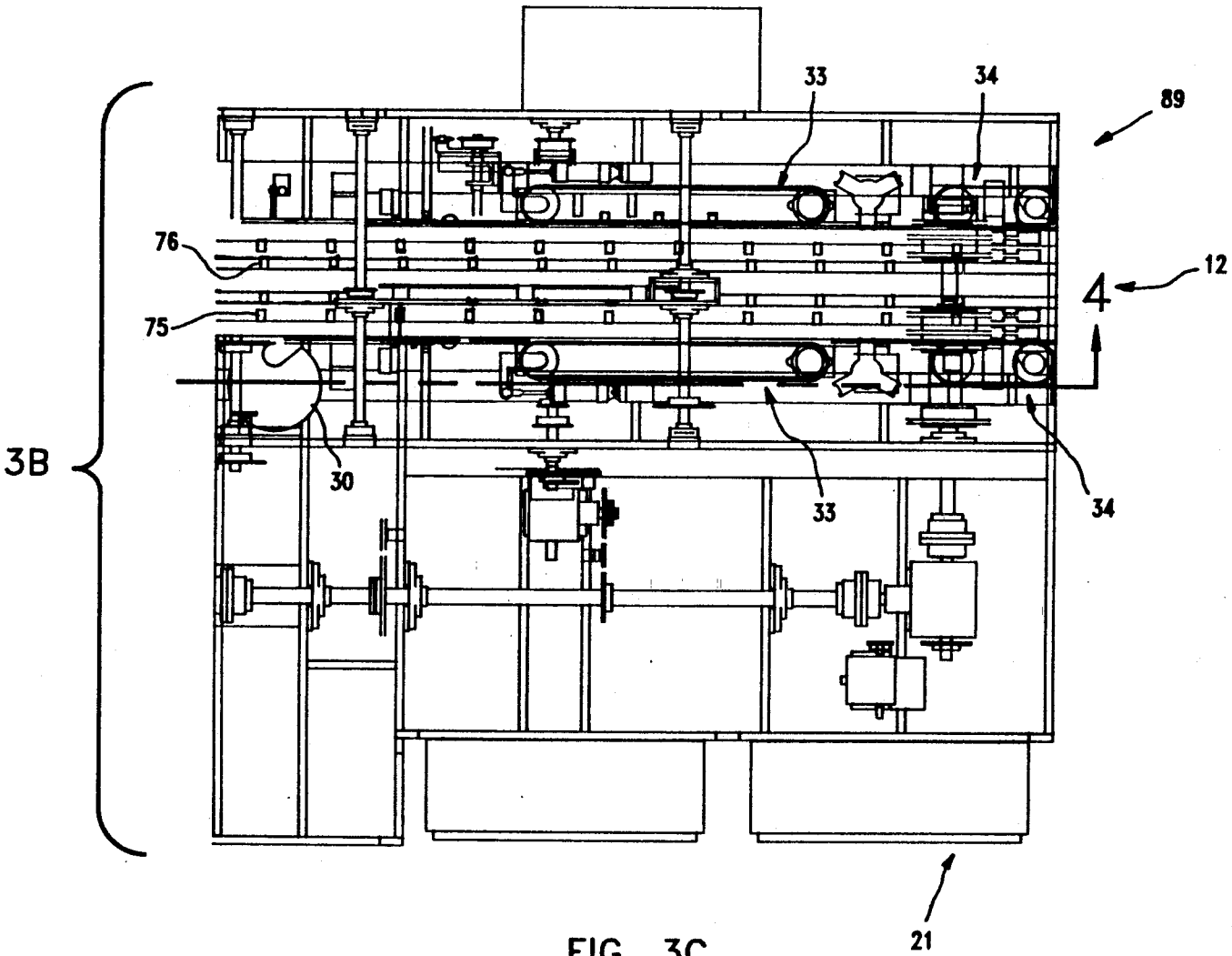
Figure 4:
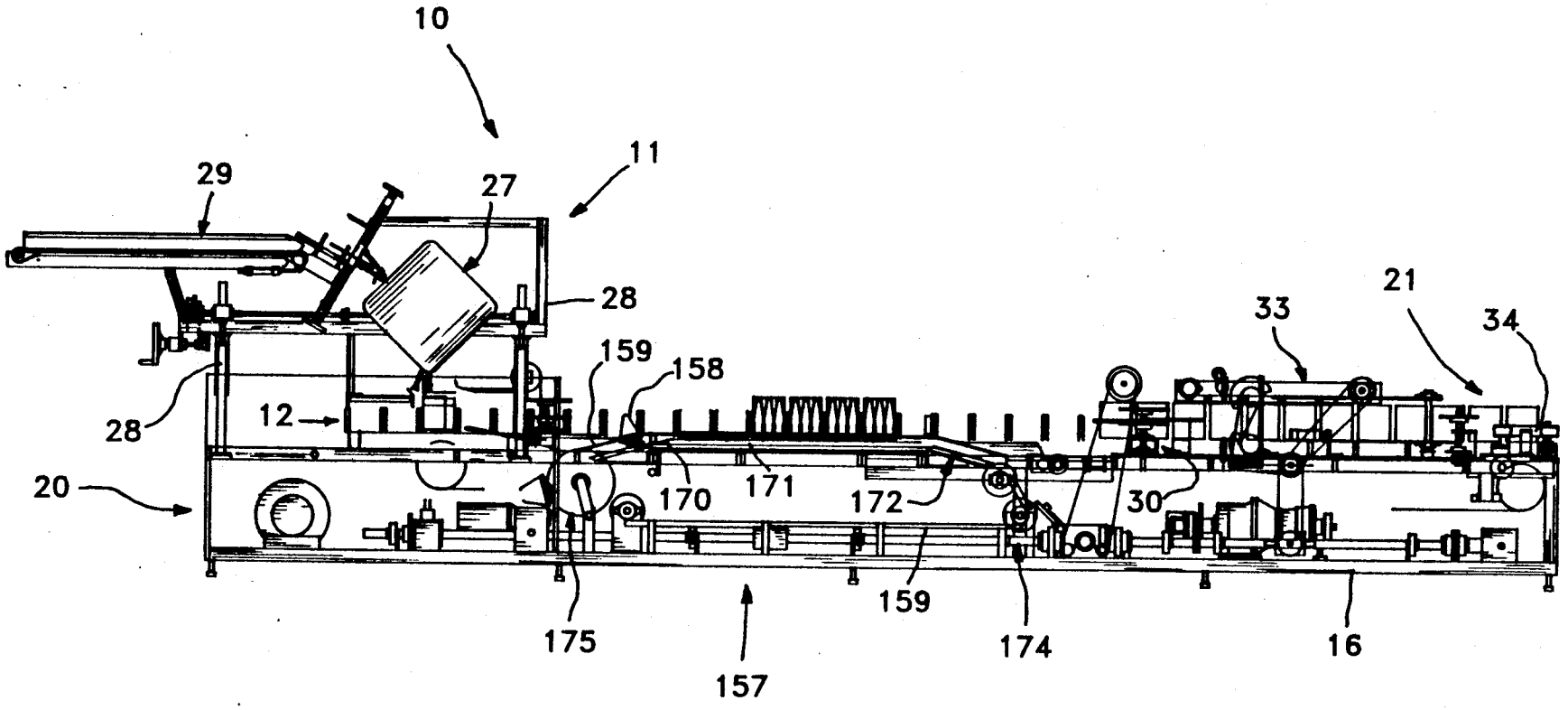
FIG. 4 is a detailed side view of the cartoner assembly taken approximately along line 4—4 of FIG. 3.
Figure 5:
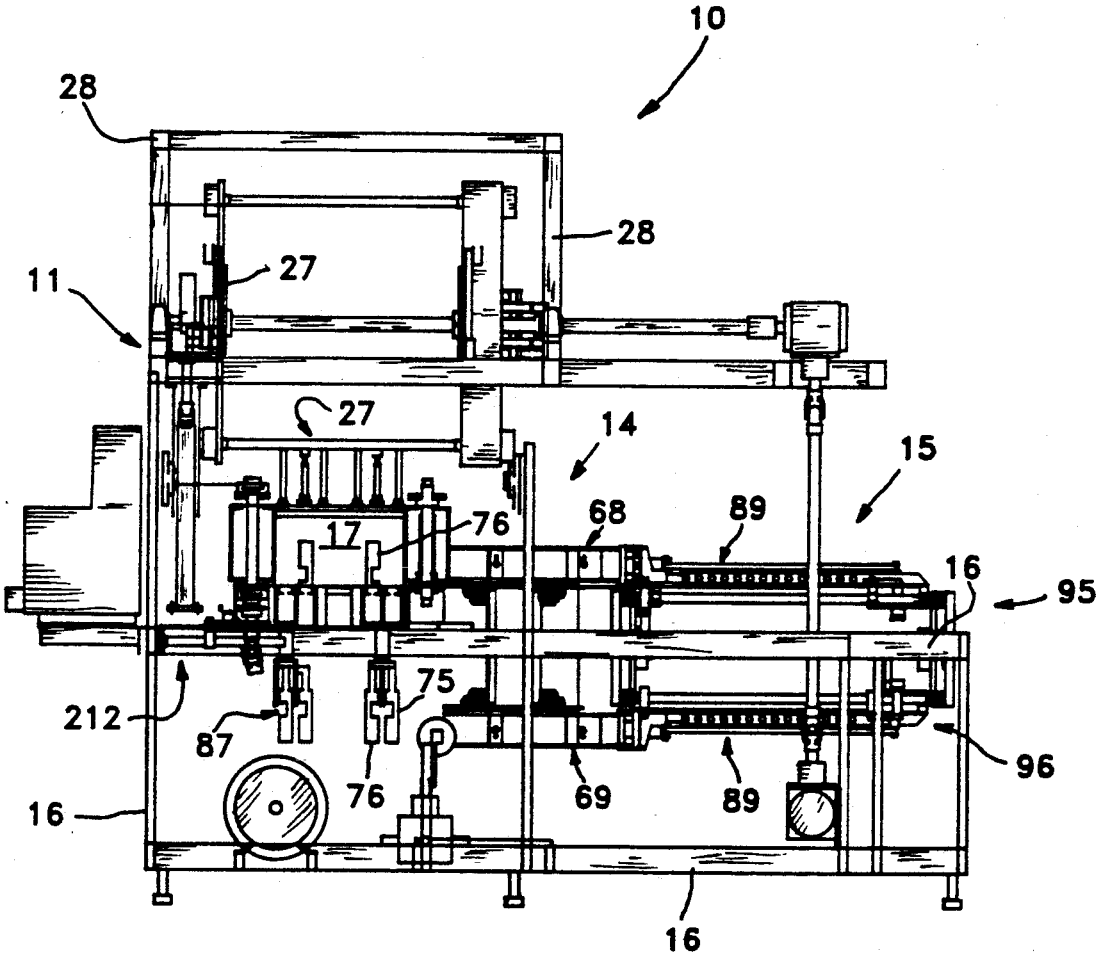
FIG. 5 is an end view of the cartoner assembly, taken from the left side of FIG. 4.

Referring to FIGS. 3–5, the carton supply mechanism 11 is preferably a rotary carton erecting apparatus 27, such as that disclosed in U.S. Pat. No. 4,530,686 owned by Applicants, assignee. The carton erecting apparatus 27 is supported above the input end of the carton transport mechanism 12 by a frame structure 28, and basically transfers flat carton blanks from a power magazine 29 to the conveyance surface of the mechanism 12, simultaneously opening the blank so that it assumes a four-sided configuration with opposing open ends bounded by at least one flap each. Importantly, the partially erected carton 17 is placed in a transverse orientation so that its ends are open to the sides of the carton transport mechanism 12 for loading purposes. In an alternative embodiment, a pair of carton supply mechanisms may be utilized to provide cartons 17 at a faster rate, for example during a 6-pack cartoning operation.

The article supply mechanism 13 provides a plurality of input individual articles 18 to the apparatus 10. The mechanism 13 is shown to comprise a conveyor 40 disposed about a drive sprocket/shaft assembly 41 and an idler sprocket/shaft assembly 42, as is known in the art. The conveyor 40 may consist of a plurality of individual tracks or paths as shown, or alternatively a unitary, wider path or belt. Also, and importantly, the articles 18 transported on the top, forward run of the conveyor 40 are separated into a plurality of single file paths by lane separators 43. Each lane separator 43 is shown to be an upstanding wall of a height sufficient to guide the flow of one or more containers 18 on the conveyor 40, and which is suspended above the conveyor 40. The lane separators 43 form product conveyance lanes which angle towards the article conveyance mechanism 14. An approach angle of approximately twenty-five (25) degrees with respect to the longitudinal axis of the mechanism 14 has been found to provide optimal results in the instant apparatus embodiment. The conveyor 40 is closely spaced with the article transport conveyor 14 to allow for product movement thereinbetween. A dead plate may alternatively be utilized. Each lane separator 43 has a terminal portion 44 of a predetermined length, such that it extends into the path of the article transport mechanism 14 a distance approximately equal to one-third the width of the mechanism 14 conveyance path. Each terminal portion 44 is constructed such that it allows longitudinally transported flight structures 52 (described further below) of the article transport mechanism 14 to pass through the angled conveyance lanes. As the flight structures 52 mesh with and pass through the lane separator end portions 44, they engage articles 18 disposed in lanes.

The combination of forces exerted by the flight bars 52, lane ends 44, and conveyors 40 and 14 serve to select and meter individual articles 18 into predetermined article groups 19 which are fully merged onto the article transport mechanism 14. The size, orientation and peripheral dimensions of the resultant product groups 19 is dependent upon the number of infeed lanes 13, product 18 dimensions, and the configuration and spacing of the flight bars 52. For example, in the instant embodiment, four lanes of product are active, and the flight bars 52 are spaced such that the resultant product group 19 is selected of twelve articles in three rows of four articles each. A pair of lanes are blocked off by closure means (not shown). The lane separators 43 and the flight bars 52 are adjustable to provide full variability of product group parameters.

The article supply mechanism 13 is shown to terminate at its infeed end 13 for mating with a complementary external apparatus, for example an additional infeed conveyor or conveyors. Alternatively, such infeed conveyor may be integrated with the apparatus 10. Further, although this embodiment utilizes conveyance lanes which initially extend in-line with the remaining elements of the apparatus 10 and subsequently angle towards the article transport mechanism 14, it is possible to provide an infeed conveyor that is entirely angled as such. Finally, it is within the purview of the present invention to utilize a two-tiered infeed with both the existing level of infeed, and an additional level which is elevated above this level. Such a configuration would provide a stacked product group. The remaining elements of this apparatus would then be modified to handle, transport and load the stacked product group into an appropriate carton.

Figure 6:
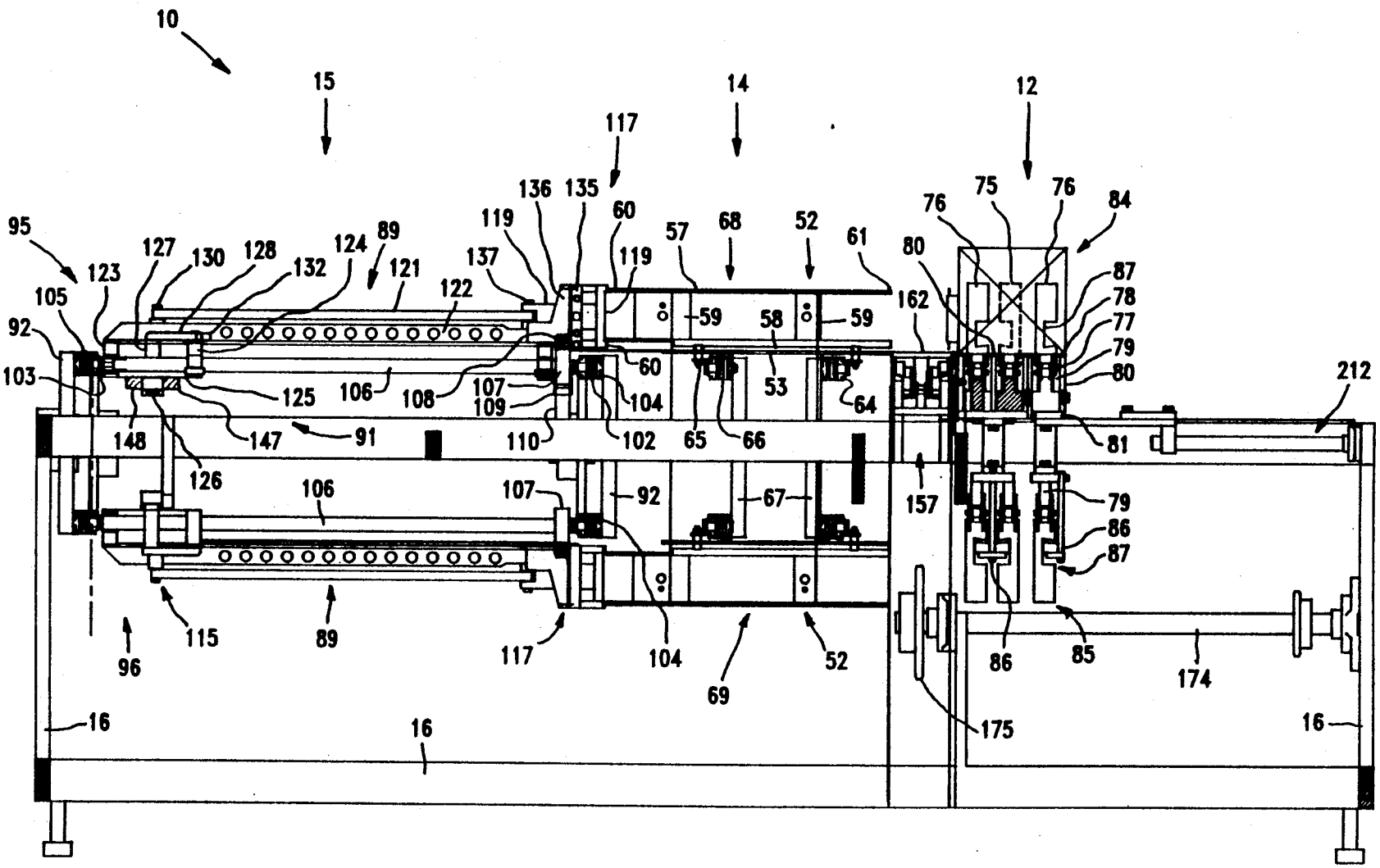
FIG. 6 is a cross-sectional view of the cartoner assembly taken approximately along line 6—6 of FIG. 3.

The article transport mechanism 14 selects article groups 19 from the article supply mechanism 13 as set forth above and transports them linearly downstream with respect to the overall apparatus 10. The downstream transport of article groups 19 is synchronized with the carton transport mechanism 12 and with the crossloading mechanism 15, as described further below, to affectuate carton 17 loading. Referring also to FIG. 6, the article transport mechanism 14 generally comprises a conveyor, a plurality of flight bars 52 fixed to and longitudinally transported on the conveyor , and at least one slide plate 53, which is also disposed on the conveyor between the flight bars 52. The conveyor runs at a predetermined speed and includes a drive sprocket/shaft assembly 55 and an idler sprocket/shaft assembly 56, a pair of parallel endless conveyor chains 64 which are connected to and revolve about the sprocket/shaft assemblies 55 and 56, forming a longitudinally extending forward or top run 68 and a return or bottom run 69. Idler assembly 56 is disposed just anterior to the area where the article supply mechanism 13 merges with the article transport mechanism 14, and marks the beginning of the conveyor. The drive sprocket/shaft assembly 55 is disposed adjacent the end of the crossloading mechanism 15 and marks the end of the conveyor. The conveyor chains 64 are each supported by a top and bottom longitudinally extending chain guide 66, which in turn are connected to the main frame 16 via upstanding conveyor supports 67. The flight bars 52 are each shown to include a top member 57 and a bottom member 58 which are connected to one another by spacer blocks 59. The top and bottom members 57 and 58 are preferably flat plate structures which are horizontally disposed, parallel to one another and spacially separated from one another by the spacer blocks 59. Each top and bottom member 57 and 58 further has an angled front end 60 and a flat back end 61. The front end 60 slants or angles inwardly, with respect to the overall flight bar structure 52, from its leading edge 62 to its trailing edge 63 to enable the flight bars 52 to select individual articles 18 disposed in the article infeed lanes and to separate them from the closely spaced nearest upstream article 18. At least one slide plate 53 is disposed between each flight bar 52 and is connected to flight chains 64. Both the flight bars 52 (via the bottom member 58) and the slide plates 53 are connected to the flight chain via connection brackets and bolts 65. The slide plates 53 are thin, flat structures with a low friction top surface which support the article groups 19 and further permit sliding movement thereon.

The height of the flight bar 52 (i.e., the separation distance between the top and bottom members 57 and 58) is a function of the container size and configuration. For example, taller bottles would require greater flight bar 52 height than a short can, for proper selection and transport. Additionally, the placement of labels and the like thereon are a factor in determining proper flight bar 52 height. The width of the top and bottom members 57 and 58 is a function of the desired dimensions of the product groups 19 formed. For example, the selection of larger or wider groups would require thinner flight bars 52. It is within the purview of this invention that the flight bar 52 height and width be fully adjustable to accommodate various container and group parameters, either by means of a modifiable flight bar or by substitution of a new flight bar. Additionally, a one-piece flight bar structure may be substituted for the two-tier structure shown.

The carton transport mechanism 12 receives cartons 17 from the carton supply mechanism 11 as set forth above and transports them linearly downstream with respect to the overall apparatus 10. The downstream transport of cartons 17 is synchronized with the article transport mechanism 14 and with the crossloading mechanism 15, as described further below, to affectuate carton 17 loading. Importantly, the carton transport conveyor 12 is adjustable to accommodate cartons 17 of varying types and sizes. Referring to FIGS. 3, 4, 6 and 14 in particular, the carton transport mechanism 12 basically comprises a plurality of flight lugs 75 and 76 which are connected to flight chains 77, the flight chains 77 being connected to and revolving about drive and idler ends 82 and 83. The number of lugs 75 and 76 per carton 17 may be varied. FIG. 6 shows an embodiment having three lugs 75 and 76, while the remaining FIGS show an embodiment having four lugs per carton 17 (two leading and two trailing). Leading lugs 75 are disposed anterior to the carton 17 for control and stabilization purposes, while the trailing lugs 76 urge the cartons forward on the conveyor mechanism 12. The lugs are preferably constructed of nylon or a similar material. The lugs 75 and 76 are attached to the flight chains 77 via lug bases 78. The flight chains 77 are supported at both the top or forward run 84 and the bottom or return run 85 of the conveyor 12 by chain guides 79. The chain guides 79 are connected to the main frame 16 via guide supports 81. An elongated, longitudinally extending return guide 86 is disposed along the bottom run 85 of the conveyor 12 and mates with a notch 87 in each lug 75 and 76 to stabilize their return during high speed operation. Additionally, longitudinally oriented slide rails 80 are disposed between each flight chain 77 and level with the horizontal plane of the article transport conveyor 14 slide plates 53. The slide rails 80 are preferably thin, elongated, metallic rails with a low-friction top surface which supports the bottom of each carton 17 on the conveyor 12. The width-wise or transverse spacing between lugs 75 and 76 on the parallel, side-by-side chains 77 is variable via a transverse lug adjustment mechanism 212, as known in the art. The in-line or longitudinal spacing between lugs 75 and 76, also known as the lug phase, is adjustable via lug phase adjustment means disposed at the drive end 82 of the conveyor 12, as described more fully below. And, lug phase adjustment may be accomplished without the use of prior art phase variators and their attendant shortcomings.

The transfer or crossloading mechanism 15 is synchronized with the aforementioned apparatus 10 elements to move article groups 19 traveling on the article transport conveyor 14 into aligned cartons 17 traveling on the carton transport conveyor 12. Referring again to FIG. 6, the crossloading mechanism 15 basically comprises a plurality of loader arm assemblies 89, a flight chain and guide tube assembly 91 to which the loader arm assemblies 89 are attached at predetermined intervals, and which provides a longitudinal movement component thereto, and a control cam assembly 90 which provides a predetermined transverse motion component to the loader arm assemblies 89.

The flight chain and guide tube assembly 91 has a forward or top run 95 and a return or bottom run 96 and comprises drive and idler sprocket/shaft assemblies 93 and 94 and a pair of spacially parallel flight chains 102 and 103 which are connected to and revolve about the sprocket/shaft assemblies 93 and 94. The idler sprocket/shaft assembly 94 is disposed adjacent and immediately posterior to the region of the article transport conveyor 14 where the product groups 19 have been fully merged therein, and marks the beginning of the flight chain assembly 91. The drive sprocket/shaft assembly 93 is disposed downstream and adjacent to the article transport conveyor drive assembly 55, and marks the end of the crossloader 15. The flight chains 102 and 103 are driven by the sprocket/shaft assembly 93. The flight chains 102 and 103 are maintained in a rectilinear configuration on both the top and bottom runs 95 and 96 by chain guides 104 and 105, which are linked to the frame 16 via vertical support members 92.

Pairs of elongated tubes 106 are disposed at predetermined intervals along the flight chains 102 and 103, each guide tube 106 being directly connected at one end to the outer flight chain 103, and at its opposite end to the inner flight chain 102 so that they are oriented transversely with respect to the axis of the apparatus 10 and to the downstream or forward run of the crossloader 15. The guide tubes 106 have a low friction exterior surface to provide slidable support of the loader arm assemblies 89. The pairs of closely spaced tubes 106 increase the stability of transverse movement of the arm assemblies 89. Further stability is attained by the guide blocks 107 (connected to the inner ends of the guide tubes 106 via set screws) traveling in a longitudinally oriented guide rail 109 which is linked to the frame 16 via a support 110. Lateral retainers 108 are mounted on the top of each guide block 107 to guide the transversely moving arm assemblies 89. The spacing between successive sets (pairs) of tubes 106 corresponds to the spacing between the flight bars 52 of the article transport conveyor 14 and of the flight lugs 75 and 76 of the carton transport conveyor 12 so that the arm assemblies 89 are aligned to push product groups 19 from between the flight bars 52 into the cartons 17.

The loader arm assemblies 89 are movably mounted on the guide tubes 106, and in a transverse orientation with respect to the axis of the apparatus 10. The arm assemblies 89 are conveyed in a downstream, longitudinal direction by the crossloader 15, while they simultaneously reciprocate in a transverse direction under the control of a cam mechanism 90 described below. Referring to FIGS. 6–11, each loader arm assembly 89 basically comprises an elongated, rectilinear base plate 116, a stepped loading head 117 located at one end of the base plate 116, pivotal means 115 to actuate the stepped head 117 located generally at the opposite end of the base plate 116, and an elongated connection bar 121 which connects the actuation means 115 to the stepped head 117.

The base plate 116 is shown to have a rigid, flat, elongated plate like structure which is oriented horizontally. A rigid stiffing bar 122 is connected to the top surface of the base plate 116, vertically oriented, to increase the rigidity and strength of the arm assembly 89. Preferably, a plurality of bores are disposed in the stiffing bar 122 to reduce the weight of the bar 122, while maintaining its strength. The inwardly disposed end of the base plate 116 is slidably supported by the lateral retainers 108 of the guide block 107 of the flight chain and guide tube assembly 91. A first or outer bushing block 123 is connected to the bottom of the base plate 116 at its actuation end 115. The first bushing block 123 has a pair of apertures, including bushings, through which the guide tubes 106 are slidably extended. A second or inner bushing block 124 is similarly connected to the base plate 116 and interfaces with the guide tubes 106 a short distance from the first bushing block 123. The bushing blocks 123 and 124 are further connected by a spreader bar 125 which is oriented and rides between the guide tubes 106. A rotatable cam follower 126 is connected to the bottom of the spreader bar 125. The longitudinally traveling cam follower 126 cooperates with the cam assembly 90 to cause the above discussed arm assembly 89 elements to transversely reciprocate on the guide tubes 106 and through the lateral retainers 108 of the guide block 107.

The loading head 117 has one or more fixed face members 118 and one or more extensible face members 119. The fixed face members 118 are connected to a backing plate 135. The extensible member 119 has a rear or tail portion which extends through an aperture 138 in the backing plate 13 and is laterally supported by vertical supports 136. The tail portion is pivotally connected to the connecting bar 121 via a connection rod 137. Referring also to FIG. 3, each face member 118 and 119 contacts an individual container or article 18 located and exposed for contact at one end of the article group 19. Since the articles are arranged in rows, as the arm assemblies 89 move forward, the face members 118 and 119 push the rows of articles forward from the article transport conveyor 14 into the cartons 17. Additionally, the face members 118 and 119 are shown to be stepped or staggered so that the adjacent rows of articles 18 are also staggered or unaligned. In this configuration, the cylindrical containers in adjacent rows rest closer to one another than they would when aligned. Hence, the width of the nested product groups 19 is less than that of the aligned groups 19. This decreased product group 19 width is exploited during carton loading to improve product group ingress reliability and speed. Subsequent to loading, this nested product group configuration is altered, as described below, to provide a taut, fully loaded, square carton 17 with minimum wasted space. The differential product group configuration provided by the stepped, actuatable loading head 117 is particularly beneficial given normal carton and beverage container manufacturing tolerances. Also, taut, fully loaded, square cartons are more stable for improved storage and handling, with less article shifting and breakage. This is especially desirable in glass beverage containers.

Still referring to FIG. 3, at the apex position of approach of each arm assembly 89, the extensible face member 119 is shown to move from a retracted position with respect to the fixed face members 118 to an extended position, wherein it is nearly flush with the fixed face members 118. This occurs at the point the product groups 19 are fully inserted into the carton 17. It is this extension which aligns the product group rows with one another, resulting in a normal product group 19. The extensible face member 119 is controlled by the cam assembly 90, via the actuation end 115 and connection bar 121. The cam assembly 90 simultaneously controls the transverse reciprocation of the entire arm assembly 89.

Figure 7:
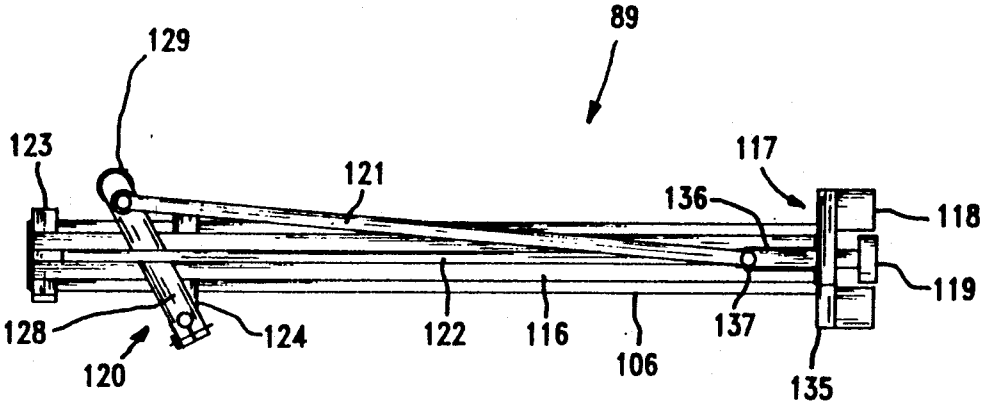
FIG. 7 is a top view of the loader arm assembly.
Figure 8:
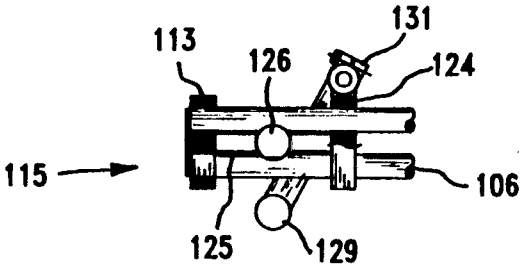
FIG. 8 is a bottom view of an end portion of the loader arm assembly partially in crossection.
Figure 9:
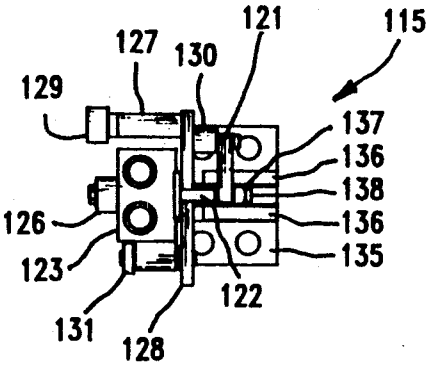
FIG. 9 is an end view of the loader arm assembly, taken from the left side of FIG. 7.
Figure 11:
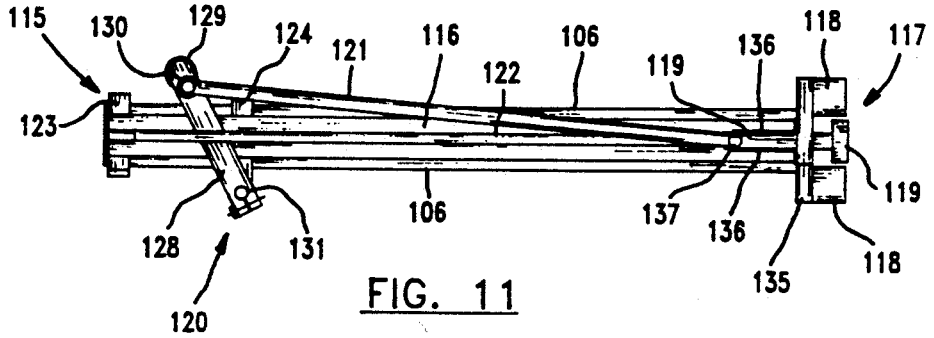
FIG. 11 is a top view of the loader arm assembly.
Figure 10:
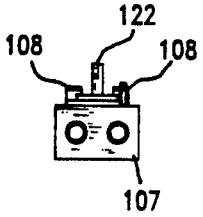
FIG. 10 is an end view of the loader arm assembly of FIG. 6, taken from the right side of the loader arm assembly.
Figure 12:
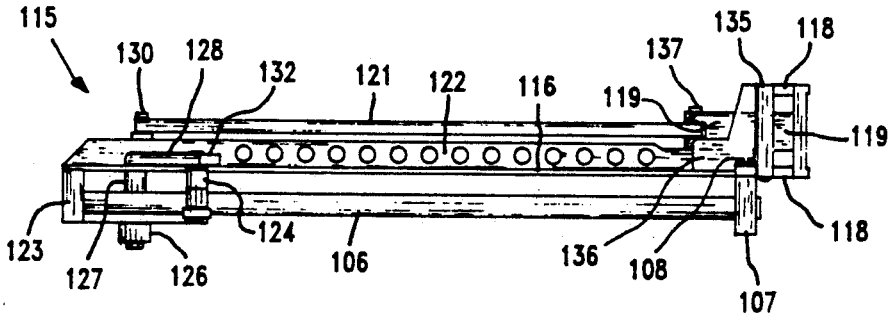
FIG. 12 is a side view of the loader arm assembly shown in FIG. 11.

A pivot arm 120 is disposed at the actuation end 115 of the arm assembly 89. Importantly, the pivot arm 120 cooperates with the cam assembly 90 to actuate (via the connecting bar 121) the loading head 117. The pivot arm 120 has a cylindrical vertical member 127 and a bar-shaped horizontal member 128 connected at a first end to the top of the vertical member 127 and oriented at a right angle thereto. The horizontal member 128 is pivotally connected at its opposite or second end to the second bushing block 124, via a pivot point 131. The connecting bar 121 is pivotally connected to the top of the horizontal member 128, proximate the first end thereof. As best shown in FIG. 7, the horizontal members 128 extends and is movable through a slotted aperture 132 (shown in FIG. 10) in the base plate stiffener 122. A rotatable cam follower 129 is disposed at the bottom end of the vertical member 127. The longitudinally moving cam follower 129 cooperates with the cam assembly 90 to cause the pivot arm 120 to pivot about point 131 and to thereby move connection bar 121 relative to the longitudinal axis of the arm assembly 89. This in turn actuates the extensible face member 119 of the loading head 117.

Figure 17:
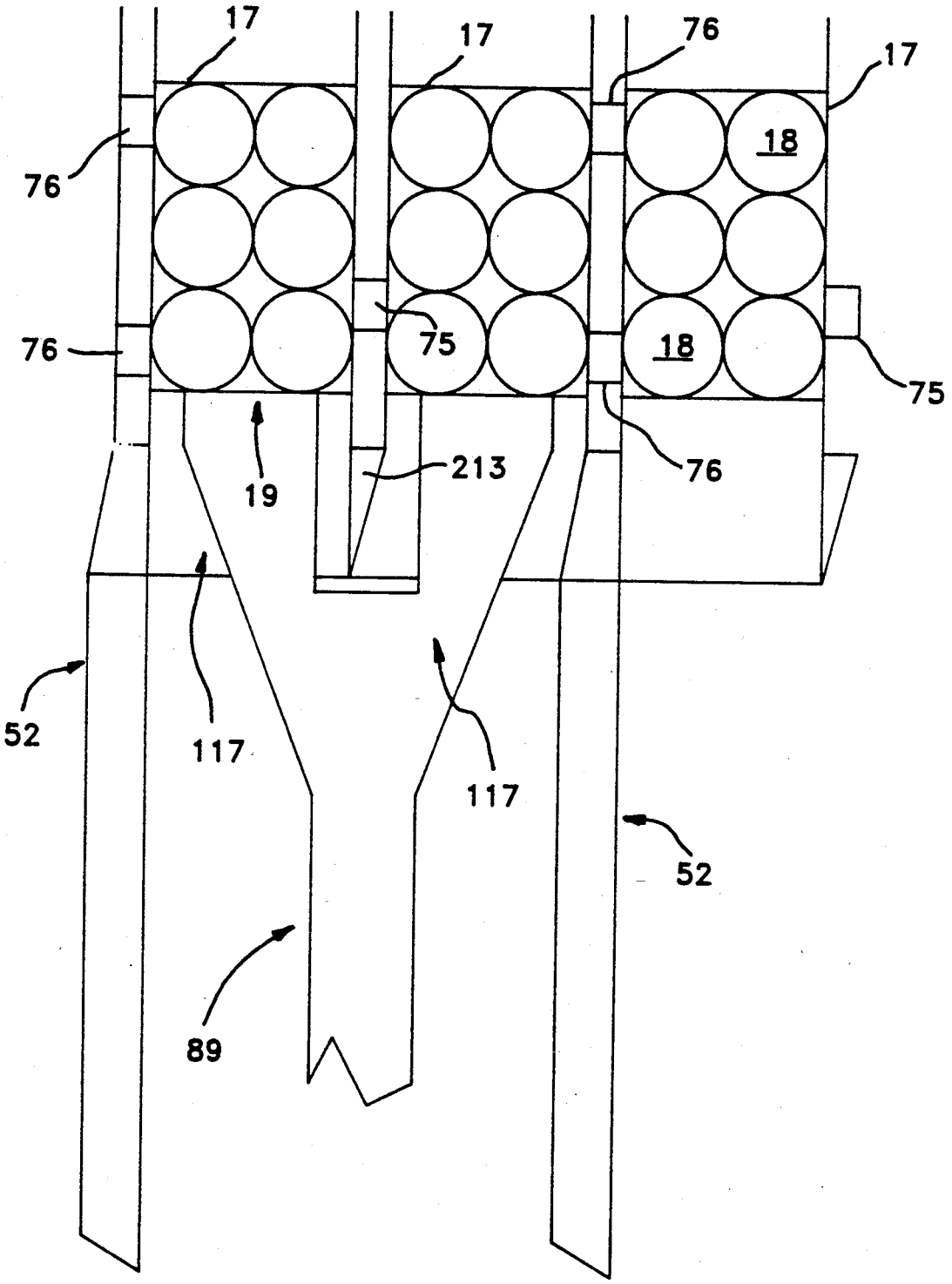
FIG. 17 is a top plan view of an alternative embodiment of the loader head of the arm assembly.

The loading head 117 configuration is variable to interface with a wide range of product group 19 configurations. Although in the instant embodiment the head 117 is configured for use with a 3 by 4 12—pack configuration, the head 117 can be modified for cartoning 2 by 6 12—packs, 6 packs, 24 packs and various other product group arrangements, including stacked configurations. The essential feature of the head 117 is that the face members contacting the end containers alternate between fixed-type members 118 and extensible-type members 119 so that the container rows may be initially staggered for loading purposes. Head 117 modification is accomplished by changes in the configuration of the face members and their placement on the backing plate 135. The head 117 configuration may also be adjusted to accommodate various container sizes, types and configurations. Additionally, the loading head 117 may be bifurcated, as shown in FIG. 17, to further divide pregrouped patterns selected by the flights 52 in cooperation with a wedge shaped dividing funnel assembly 213. Utilizing this head 117 configuration the apparatus 10 has the ability to achieve cartoning rates approximately twice that of conventional systems. Modifications may be made to the remaining elements of the crossloader 15 to provide cam-actuated stepped faces in this twin-headed embodiment.

Figure 13:
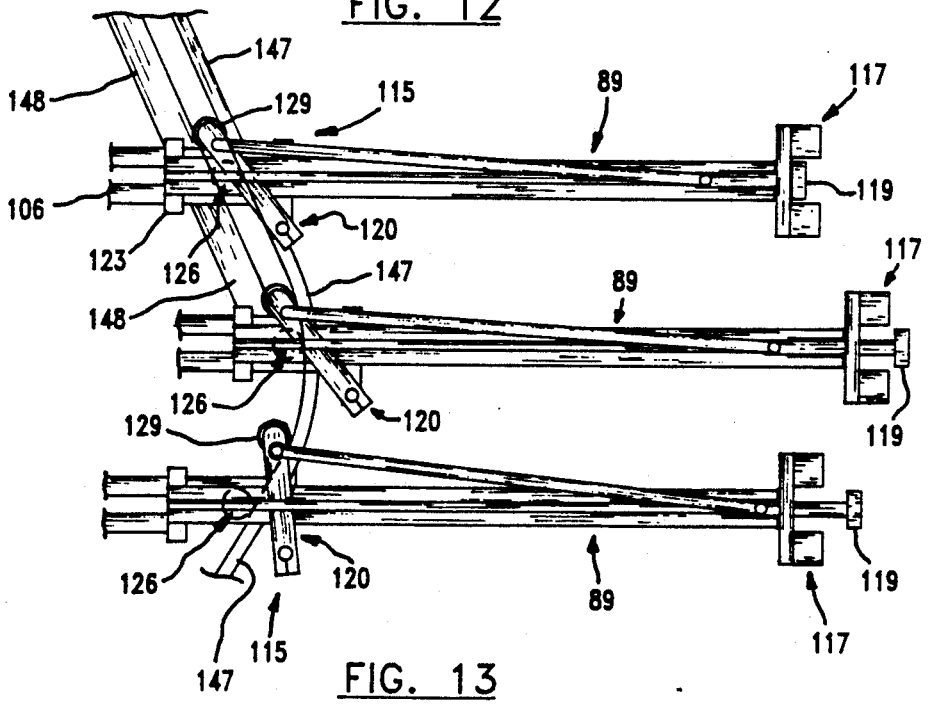
FIG. 13 is a top view of a portion of the cross loader mechanism showing the cooperation of the loader arm assemblies with the cross loader cam assembly and the relative motion thereinbetween.

The loader control cam assembly 90 controls the transverse, reciprocal motion of both the overall arm assemblies 89 and the extensible face members 119 of the arm assembly loading heads 117. Referring to FIGS. 3 and 13, the loader control cam assembly 90 is generally oriented longitudinally with respect to the overall crossloading mechanism 15, and has a top or forward run 142 and a bottom or return run 143 corresponding to the revolving arm assemblies 89. The top run 142 basically comprises an inwardly sloping approach segment 144, an active segment 145 located at the apex of the approach segment 144 and involving a change in direction thereof, and an outwardly sloping dwell segment 146. In the approach segment 144, the first or arm cam follower 126 is urged inwardly, with respect to the apparatus 10, and drives each arm assembly 89 into moving engagement with a product group 19 until the product group 19 is loaded in a carton 17. At this point the cam follower 126 is at the apex position of the cam assembly 90. As best shown in FIG. 13, the second or extensible member cam follower 129 is also guided inwardly in the approach segment 144, but since it is linearly aligned and traveling along with the first cam follower 125, no relative movement exists between these two elements 126 and 129. In contrast, as each arm assembly 89 reaches the apex 145 of the cam assembly 90, the first cam follower 126 moves out of linear alignment with the second cam follower 129. The second cam follower 129 no longer moves the arm assembly 89 in a transverse direction, and instead it is propelled only longitudinally. However, the spacially trailing second arm follower continues to undergo transverse movement due to the inwardly sloping cam segment 144, causing the pivot arm 120 to pivot about point 131 and thereby activating the extensible member 119. In the outwardly sloping dwell segment 146, a complete pivot of the pivot arm 120 is accomplished, with resultant full extension of the extensible member 119. Throughout this segment 146, the cam rollers 126 and 129 are once again linearly aligned during travel and therefore no further relative motion occurs. Each arm assembly 89 is retracted by the outward movement of the cam roller 126. In the return run 143 of the cam assembly 90, the arm assemblies 89 are longitudinally returned to the forward run 142 and undergo no transverse motion. Additionally, the pivot arm 120 is reset in the return run 143 to its position in the approach segment 144. Still referring to FIG. 13, the forward run 142 of the cam assembly 90 comprises a continuous inner rail 147 which extends the entire length of the top run 142, and an outer rail 148 which extends the length of the approach segment 144 and is spaced from the inner rail 147 a distance equivalent to the diameter of the second cam follower 129. The second follower 129 is disposed in a cam pathway between the inner and outer rails 147 and 148 to affectuate transverse, inward motion to the arm assemblies 89. Preferably, the outer rail is connected to a pivot point 149 at it's first end. Its opposite end is connected to a release mechanism (not shown), such as a pressure release cylinder and piston. The release mechanism is controlled by a sensing mechanism, for example, a photoeye or capacitive proximity sensor, such that if an excessive force is placed on the outer rail 148, for example due to a jamming of the arm assembly 89, the release mechanism will be actuated releasing the outer rail 148 which pivots about point 149.

Figure 15:
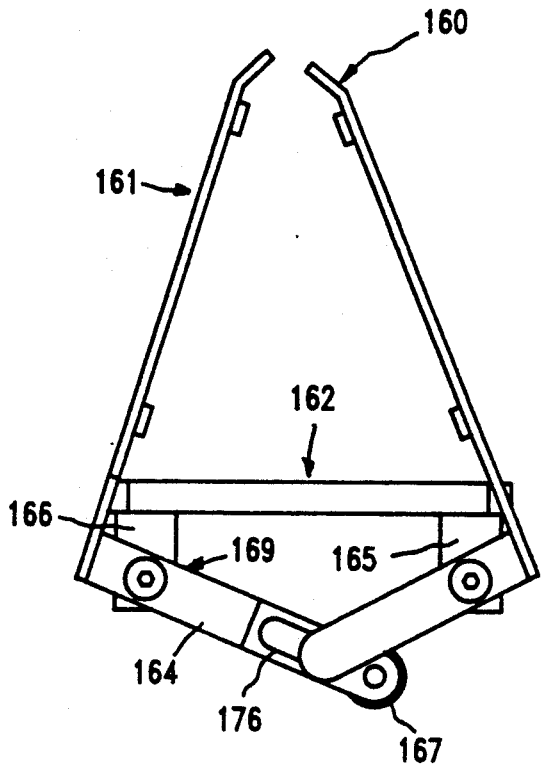
FIG. 15 is a side view of the funnel assembly shown in FIG. 4.
Figure 16:
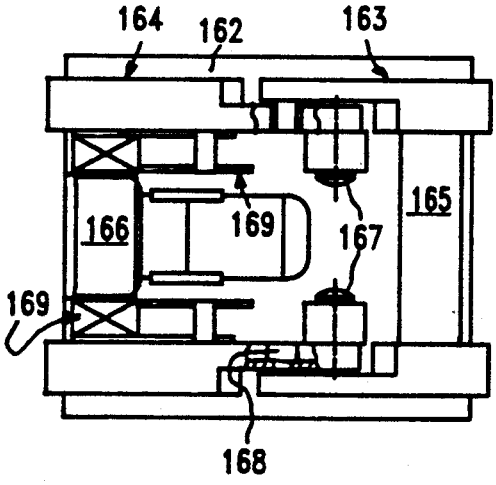
FIG. 16 is a bottom view of the funnel assembly shown in FIG. 15.

Referring to FIGS. 4, 15 and 16, a funnel assembly 157 is shown disposed between the article transport conveyor 14 and the carton transport conveyor 12 to facilitate entry of product groups 19 into the cartons 17. The funnel assembly 157 basically comprises a plurality of funnels 158 which are fixed at predetermined intervals, corresponding to the remaining elements of the apparatus 10, to a longitudinally oriented, revolving flight chain 159. The flight chain 159 is supported by a base which includes actuation, dwell and release cam surfaces 170, 171 and 172 which control the actuation of the funnels 158. The chain 159 revolves about drive and idler sprocket/shafts 174 and 175 and is specifically supported by a chain guide 173. Each funnel 158 comprises a base 162, first and second guides 160 and 161, a pair of first arms 163, a pair of second arms 164, and first and second blocks 165 and 166. The base 162 is a flat plate with a low friction top surface to provide sliding support of product groups 19 moved thereacross. The base 162 must be wide enough to bridge the gap between conveyors 12 and 14, and long enough to accommodate the width of the product group 19. The guides 160 and 161 are flat plates which are pivotally mounted at the length-wise first and second ends of the base 162. The guides 160 and 161 have a height which is a function of the height of the containers 18. The first and second arms 163 and 164 are connected to the bottom of the respective first and second guides 160 and 161, and extend therefrom at a right angle. The first arms 163 are further pivotally connected to a first block 165 disposed on the bottom of the base 162 at a first end. The second arms 164 are similarly connected to a second block 166 disposed on the bottom of the base 162, at the second end. The ends of the first arms 163 have rods 168 which pivotally mate with slots 176 disposed proximate the ends of the second arms 164. A cam follower 167 is disposed at the end of each of the second arms 164. This structure pivots the guides 160 and 161 under cam control. A spring 169 normally urges the arms 163 and 164 downwardly, whereby the guides 160 and 161 are angled inwardly or closed. In this closed orientation, the guides 160 and 161 are positioned to slide between the carton side end flaps (dust flaps) and into an operative orientation as they are conveyed upwardly by the flight chains 159. Subsequently, the active cam surface 170 urges the cam follower 167 upwardly which causes the guides 160 and 161 to pivot to a vertical or open position. In this orientation, the carton flaps are held aside and the product groups 19 are guided into the carton 17. Although this apparatus embodiment utilizes this particular cam actuated funnel assembly 157, it is within the purview of the present invention to utilize alternative funnel assembly embodiments or to substitute a dead plate structure in place of a funnel assembly depending upon the particular cartoning application.

Figure 14:
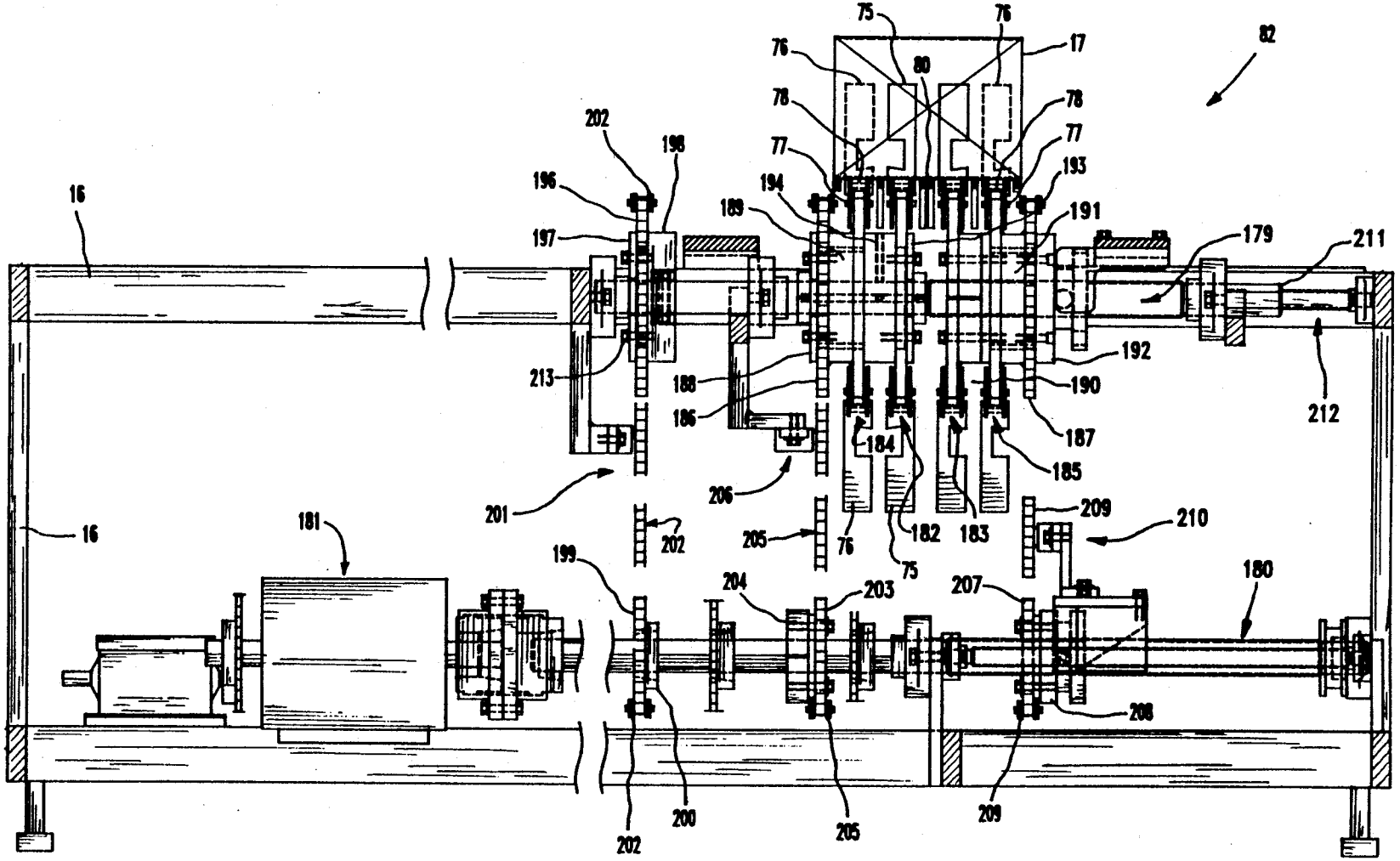
FIG. 14 is an end view of the cartoner assembly taken from the right side of FIG. 4 and showing the carton flight lug longitudinal phase adjustment features thereof.

Referring to FIG. 14, the drive end 82 of the carton transport conveyor 12 primarily functions to longitudinally convey cartons 17 downstream in the apparatus and further provides a means to adjust the longitudinal separation distance between or phase of the leading and trailing flight lugs 75 and 76. This phase adjustment is desirable to permit the apparatus 10 to be used with various carton configurations. The drive end 82 components are shown to primarily comprise a first or top drive shaft 179, a second or bottom drive shaft 180, a gear box 181, and a plurality of head sprockets 182-185 mounted on the first or head shaft 179. The flight lugs 75 and 76 mounted on flight chains 77 are longitudinally moved via rotation of their respective head sprockets 182-185. The flight lugs 75 and 76 are linked to flight chains 77 via lug bases 78. Slide rails 80 are shown disposed between flight chains 77 for support of the carton 17 bottom.

The first or head shaft 179 is fixed to the mainframe 16 directly above and spacially parallel to the second drive shaft 180. The second drive shaft 180 is also connected to the frame 16, and further to the gearbox 181 which is communicatively connected to a main motor (not shown). Rotational force from the second drive shaft 180 is transferred to the first drive shaft 179 via drive chain 202, which is connected to drive sprockets 199 and 196. Drive sprocket 199 is coupled to second drive shaft 180 via taper lock bushing 200, and drive sprocket 196 is releasably coupled to first drive shaft 179 via clamp plate 197 and drive hub 198. Chain 202 tension is adjustable via take up 201. Only the leading lug head sprockets 182 and 183 are directly linked to the first drive shaft 179 and rotated thereby. The trailing lug tail sprockets 184 and 185 are merely rotatable about the first drive shaft 179, but not driven by its rotation. The first leading lug head sprocket 182 is coupled to the first drive shaft 179 via clamp plate 193 and fixed hub 194. The second leading lug head sprocket 183 is split and coupled to a drive hub 191. This structure permits removal of the leading lug sprocket 183 and its associated elements for conversion of the apparatus for 6-pack cartoning function as shown in FIG. 6.

The first trailing lug head sprocket 184 is mounted for rotation about the first drive shaft 179 via clamp plate 188 and bushing 189. Drive sprocket 186 is provided to interface with drive chain 205 for transfer of rotational force from the second drive shaft 180. Drive chain 205 is coupled to the second drive shaft 180 via drive sprocket 203 which in turn is attached to the shaft 180 via clamp hub 204. Tension in drive chain 205 is adjustable via take up 206. The second trailing lug head sprocket 185 is mounted for rotation about the first drive shaft 179 via splined hub 190, drive hub 191 and splined adjustment hub 192. Drive sprocket 187 interfaces with drive chain 209 for transfer of rotational force from the second drive shaft 180. Drive chain 209 is coupled to drive shaft 180 via drive sprocket 207, which in turn is attached to the shaft 180 via splined hub 208. Chain tension adjustment is provided by take up 210.

In a normal conveyance mode, rotational force from the second drive shaft 180 is transferred to both the leading lug conveyance components, via direct connection to the first drive shaft 179, and to the trailing lug conveyance components freely rotating about the first drive shaft 179, by the sprocket and drive chain structures described above. And, since these structures have corresponding dimensions, the rate of rotation of the trailing and leading conveyance components is synchronized such that a constant longitudinal phase is maintained. Lug phase is varied by first disengaging the first and second drive shafts 179 and 180, and subsequently rotating the first drive shaft 179 to advance the leading lugs 75. Since the trailing lugs 76 rotate freely with respect to the first drive shafts 179, they remain stationary during such rotation. Disengagement of the second drive shaft 180 is accomplished by loosening bolts 213 to free drive sprocket 196 from the first drive shaft 179. Rotation of the first drive shaft 179 is accomplished by means of a hex end 211 which is shown exposed for mating with a wrench or the like at an area of the apparatus 10 which is easily accessible to a technician. This mechanism allows for adjustment of carton spacing between, for example, 6 and 12 inch, on center arrangements whereby the apparatus is quickly and easily converted from 6 to 24 pack processing.

Many changes are possible to the embodiments of this invention utilizing the teachings thereof, the descriptions above, and the accompanying drawings should be interpreted in the illustrative and not the limited sense.

That which is claimed is:

1. A cartoner assembly for loading article groups into open carton sleeves comprising:

a) an article infeed conveyor having a plurality of parallel guide structures fixed thereabove, said article infeed conveyor supplying a first stream of articles;

b) an article selecting conveyor having a plurality of spaced, parallel and transversely oriented fixed flight bars and a longitudinal travel path disposed adjacent to and parallel with said article infeed conveyor, said flight bars intersecting said article infeed guide structures at a predetermined angle to form and move a second longitudinal stream of article groups of a predetermined pattern;

c) a carton supply conveyor having spaced carton flight lugs synchronized and moving adjacent to and parallel with said article selecting conveyor to provide a third longitudinal stream of cartons with open ends facing said moving article groups; and d) article group transfer means for moving article groups into the open ends of the carton sleeves, said article group transfer means comprising guide support means longitudinally moving in parallel synchronization with said carton supply conveyor, a plurality of transversely operative, longitudinally moving pushing mechanisms, and activation means to transversely move said pushing mechanisms at predetermined longitudinal positions.

2. The cartoner assembly of claim 1, further comprising article funnel means movable between said carton supply means and said article group transfer means and being constructed and arranged to guide said article groups into the cartons and to maintain carton flap position as said transfer means is operative.

3. The cartoner assembly of claim 2, wherein said funnel means includes opposing vertically disposed plate members.

4. The cartoner assembly of claim 1, wherein said flight bars have a predetermined length and width and further have width adjustment means.

5. The cartoner assembly of claim 4, wherein said article selecting means further comprises a pair of driven endless chains having spaced connecting means attaching said parallel flight bars therebetween.

6. The cartoner assembly of claim 5, wherein said flight bars have a forward corner edge and a slanted side sloping inwardly therefrom, said slanted side being disposed on the side intersecting said article infeed means.

7. The cartoner assembly of claim 3, wherein said funnel means has cam means to open and close said plate members at predetermined positions of travel.

8. The cartoner assembly of claim 1, Wherein said carton lugs are arranged in groups of at least two, at least one said lug leading each carton and at least one said lug pair trailing each carton.

9. The cartoner assembly of claim 8, wherein said leading and trailing lugs are adjustable with respect to each other in both transverse and longitudinal directions.

10. The cartoner assembly of claim 9, wherein said carton supply means further comprises two pairs of driven endless chains having spaced connecting means attaching said lugs.

11. The cartoner assembly of claim 10, wherein said driven chains include drive means comprising a first drive shaft having a at least one trailing sprocket and at least one leading sprocket and a second drive shaft, said leading sprocket being driven by said first drive shaft, said trailing sprocket being mounted on bushings so that they freely rotate about said first drive shaft and are driven by said second drive shaft in synchronization with said first drive shaft.

12. The cartoner assembly of claim 11, wherein said first drive shaft is rotatable with respect to said second drive shaft to advance said leading lug with respect to said trailing lug.

13. The cartoner assembly of claim 1, wherein said activation means comprises a cam track/cam follower assembly.

14. The cartoner assembly of claim 13, wherein said pushing mechanism includes a movable head member, cam activatable at predetermined times with respect to said travel path.

15. The cartoner assembly of claim 14, wherein said pushing mechanism includes a pivotable member connected to said movable head member and having a cam follower acted upon by said cam track/cam follower assembly.

16. The cartoner assembly of claim 15, wherein said head member has fixed and cam activated extensible face portions.

17. A continuous motion cartoner assembly for loading article groups into the open ends of cartons being moved on a conveyor comprising:

a) a frame structuring having an elongated, horizontal working area, two pairs of longitudinally oriented carton drive chains, a pair of longitudinally oriented article drive chains parallel said carton drive chains and synchronized means to drive said chains;

b) a continuous cam rail structure longitudinally mounted to said frame structure and having transverse inwardly and outwardly sloping sections;

c) a plurality of carton lugs connected to each said pair of carton drive chains and spaced at predetermined intervals;

d) a plurality of transversely oriented, fixed article transfer flights connected between said article drive chains;

e) an article infeed conveyor disposed angularly with respect to said article transfer flights to provide a continuous stream of articles for pickup by said article transfer flights;

f) a carton transfer device for placing open ended cartons between said carton lugs; and g) a plurality of longitudinally conveyed article group transfer structures, one said transfer structure being operative between adjacent article transfer flights and being constructed and arranged to transversely move article groups into the opened end of the cartons.

18. An adjustable cartoner assembly for loading article groups into open carton sleeves comprising:

a) an adjustable article infeed conveyor having a plurality of parallel guide structures fixed thereabove, said article infeed conveyor supplying a first stream of articles, said guide structures having adjustment means constructed and arranged to adjust the number of article streams;

b) an adjustable article selecting conveyor having a plurality of spaced, parallel and transversely oriented fixed flight bars and a longitudinal travel path disposed adjacent to and parallel with said article infeed conveyor, said flight bars intersecting said article infeed guide structures at a predetermined angle to form and move a second longitudinal stream of article groups of a predetermined angle to form and move a second longitudinal stream of article groups of a predetermined pattern, said flight bars being constructed and arranged to select a predetermined pattern or article groups;

c) an adjustable carton supply conveyor having spaced carton flight lugs synchronized and moving adjacent to and parallel with said article selecting conveyor to provide a third longitudinal stream of cartons with open ends facing said moving article groups;

d) adjustable article group transfer means for moving article groups into the open ends of the carton sleeves, said article group transfer means comprising guide support means longitudinally moving in parallel synchronization with said carton supply conveyor, a plurality of transversely operative, longitudinally moving pushing mechanisms, and activation means to transversely move said pushing mechanism at predetermined longitudinal positions; and e) article funnel means movable between said carton supply conveyor and said article group transfer means and being constructed and arranged to guide said article groups into the cartons and to maintain carton flap position as said transfer means is operative.

19. A cartoner assembly for loading article groups into open carton sleeves comprising:

a) article infeed means supplying at least one stream of articles;

b) article selecting means intersecting said article infeed means to form and move a longitudinal stream of article groups of a predetermined pattern;

c) carton supply means synchronized and moving parallel with said article selecting means to provide cartons with open ends facing said moving article groups, said carton supply means comprising a plurality of spaced, transversely and longitudinally adjustable carton flight lugs arranged in groups of at least two, at lest one said lug leading each carton and at least one said lug pair trailing each carton, said carton supply means further comprising two pairs of driven endless chains having spaced connecting means attaching said lugs, and drive means including a first drive shaft having at least one trailing sprocket and at least one leading sprocket and a second drive shaft, said leading sprocket being driven by said first drive shaft, said trailing sprocket being mounted on bushings so that they freely rotate about said first drive shaft and are driven by said second drive shaft in synchronization with said first drive shaft; and d) article group transfer means constructed and arranged to move article groups into the open ends of the carton sleeves.

20. A cartoner assembly for loading article groups into open carton sleeves comprising:

a) article infeed means supplying at least one stream of articles;

b) article selecting means intersecting said article infeed means to form and move a longitudinal stream of article groups of a predetermined pattern;

c) carton supply means synchronized and moving parallel with said article selecting means to provide cartons with open ends facing said moving article groups; and d) article group transfer means constructed and arranged to move article groups into the open ends of the carton sleeves, said article group transfer means comprising guide support means moving in parallel synchronization with said carton supply means, a movable pushing mechanism operative in a transverse direction, and a cam track/cam follower assembly to move said pushing mechanism at predetermined positions during its travel path, said pushing mechanism including a movable head member, cam activatable at predetermined times with respect to said travel path and a pivotable member connected to said movable head member and having a cam follower acted upon by said cam track/cam follower assembly.

* * * * *

Disclaimer 5,241,806— Kelly W. Ziegler, Allen L. Olson, both of Crosby; Curt W. Lovold, Baxter, all of Minn. Continuous Motion Cartoner Assembly. Patent dated September 7, 1993. Disclaimer filed March 7, 2001, by the assignee, Riverwood International USA, Inc.

Hereby enters this disclaimer to claims 1 and 13 of said patent.

*(Official Gazette, November 6, 2001)*